US005549028A

United States Patent [19]

Steinberger

[11] Patent Number: 5,549,028

[45] Date of Patent: Aug. 27, 1996

[54] CHROMATIC TUNER DISPLAY PROVIDING GUITAR NOTE AND PRECISION TUNING INFORMATION

[76] Inventor: Ned Steinberger, 153B Jackson Ave., New Windsor, N.Y. 12550

[21] Appl. No.: 144,472

[22] Filed: Nov. 2, 1993

Related U.S. Application Data

[63] Continuation-in-part of Ser. No. 966,391, Oct. 26, 1992, abandoned.

[51] Int. Cl.[6] ..... G10G 7/02

[52] U.S. Cl. ..... 84/454; 84/DIG. 18

[58] Field of Search ..... 84/454, DIG. 18

[56] References Cited

U.S. PATENT DOCUMENTS

| | | | |
|---|---|---|---|
| 2,958,250 | 11/1960 | Poehler | 84/454 |
| 3,861,266 | 1/1975 | Whitaker | 84/454 |
| 3,968,719 | 7/1976 | Sanderson | 84/454 |
| 4,014,242 | 3/1977 | Sanderson | 84/454 |
| 4,088,052 | 5/1978 | Hedrick | 84/454 |
| 4,120,229 | 10/1978 | Ota | 84/454 |
| 4,429,609 | 2/1984 | Warrender | 84/454 |

FOREIGN PATENT DOCUMENTS

| | | |
|---|---|---|
| 52-33573 | 3/1977 | Japan . |
| 59-5926A | 12/1984 | Japan . |
| 2-153393A | 6/1990 | Japan . |
| 2198874 | 6/1988 | United Kingdom . |

*Primary Examiner*—Cassandra C. Spyrou

*Attorney, Agent, or Firm*—Finnegan, Henderson, Farabow, Garrett & Dunner, L.L.P.

[57] ABSTRACT

A chromatic tuner display is provided for indicating a relative difference between a pitch of a sound and a pitch of a desired note of a musical scale. The display comprises a base member, a predetermined point on the base member corresponding to the pitch of the desired note, and a colored light arrangement for visually representing the pitch of the sound. The colored light arrangement is mounted on the base member and includes a plurality of illuminative letters corresponding to notes of the musical scale, and a plurality of additional illuminative characters positioned on the base member between adjacent letters corresponding to sharp and flat variations of the notes represented by the letters. An illuminated letter or an illuminated letter and character combination represents the desired note. The colored light arrangement also includes a plurality of opposing pairs of colored light devices for visually indicating whether the sound is above or below the pitch of the desired note, each light device within a given opposing pair being disposed on an opposite side of the predetermined point from the other light device within the given opposing pair. Each opposing pair has a specified color for visually indicating the relative difference in the pitch of the sound from the desired note. The colored light arrangement may indicate whether the note corresponding to the pitch of the sound is a standard guitar note or a non-standard guitar note, and may also indicate whether the pitch of the sound is within a first predetermined range from the desired pitch smaller than a second predetermined range of about ±2 to 3 cents from the desired note.

13 Claims, 4 Drawing Sheets

CHROMATIC TUNER DISPLAY PROVIDING GUITAR NOTE AND PRECISION TUNING INFORMATION

The present application is a continuation-in-part U.S. application Ser. No. 07/966,391 filed Oct. 26, 1992 now abandoned.

INCORPORATION BY REFERENCE

Applicant's U.S. patent applicaiton Ser. No. 08/251,632 filed May 31, 1994 and issued as U.S. Pat. No. 5,247,011 is a continuation of U.S. Ser. No. 07/966,391 filed Oct. 26, 1992 now abandoned. U.S. Pat. No. 5,472,011 is hereby incorporated by reference.

BACKGROUND OF THE INVENTION

1. Field of the Invention

This invention relates to electronic tuning aids for use in tuning stringed musical instruments. More particularly, the invention relates to displays used on electronic tuning aids to provide a visual indication of necessary pitch adjustments to reach a desired musical note.

2. Description of the Related Art

Various types of electronic tuning aids have been disclosed in the prior art. For example, U.S. Pat. No. 2,958,250 describes a musical instrument tuning apparatus having a control panel with 12 black and white keys corresponding to the notes of the chromatic musical scale displayed thereon. In operation, a cathode ray tube compares the frequency of a string to a calibrated predetermined frequency. The cathode ray tube display is utilized to determine when the two frequencies are coincident. The black and white keys on the control panel are push buttons which correspond to the notes of the chromatic musical scale. A player sounds a note on the instrument and depresses the corresponding button of the apparatus. The pitch is then adjusted by watching the cathode ray tube display.

In U.S. Pat. No. 4,088,052, the pitch of a stringed instrument is compared with a known standard, and an output error signal is generated. An audio amplifier responsive to the output error signal drives a motor and gear train to automatically tension the string pin of the instrument until the error signal amplitude is reduced to a predetermined level.

U.S. Pat. No. 3,861,266 describes a musical tuning instrument utilizing digital techniques in which a visual display indicates whether a musical tone is higher or lower than a particular musical note. The actual tones are compared in frequency with reference frequencies and the comparison is indicated by a pattern on a light emitting diode display. The display consists of 16 LEDs formed in a circle. If a note sounded into a microphone is exactly 440 Hz, a stationary pattern of half the LEDs lit and the other half unlit will appear. If the note is low, the pattern on the display will rotate in one direction and if the note is high it will rotate in the opposite direction. The rate of rotation indicates how far off the note is from the reference signal.

In U.S. Pat. No. 3,968,719, a display unit consisting of pairs of opposed light emitting diodes is arranged in a circle. When a note is in tune, one pair of lamps may be at or nearly at full brilliance, or two pairs may be partially lit. If there is a frequency deviation, the individual lamp pairs reach full brilliance in one of two sequences. If the note is sharp, then the lamps reach full brilliance in a clockwise sequence so the display appears to rotate clockwise. When a note is flat the sequence is reversed and the display appears to rotate counter clockwise. The rate at which the display appears to rotate indicates the magnitude of the deviation from the desired note.

U.S. Pat. No. 4,429,609 discloses a pitch analyzer in which pitch information is converted into appropriate display driving signals which are directed to a visual display in the form of a treble clef.

All of these patents involve attempts at solving a problem of providing a rapid and efficient means for assisting a musician to tune a stringed musical instrument. Tuning of a stringed instrument needs to be accurate and simple so that inordinate amounts of time are not required. In addition, it is desirable for a tuner display to be compact and visually attractive. Ability to see the display in various light conditions and to quickly recognize the magnitude of pitch deviations is desirable.

Applicant's U.S. patent application Ser. No. 07/966,391, filed Oct. 26, 1992, discloses a chromatic tuner display having a number of light devices which provide a musician with various information regarding the tuning of a stringed musical instrument. For example, the display gives the musician information as to which musical note the pitch being played most closely approximates. Also, the display gives the musician information as to how closely the pitch being played approximates the desired pitch.

However, this tuning display has two minor drawbacks. First, the tuning display gives information as to the closeness of the played pitch to the desired pitch only to within 2 "cents." Typically, chromatic tuning devices indicate the variance from an exact pitch of a note in units of 100 cents, with 0 indicating exact pitch, and a maximum error of ±50 cents. Most people cannot discern a difference in pitch of less than about 2 or 3 cents. Therefore, tuning to within 2 or 3 cents is generally sufficient for most uses. However, for some uses, such as during recording, tuning to within 1 cent is desired and is not possible with the above device.

Second, since the above device has display elements corresponding to each note of the musical scale, a musician may inadvertently tune a string to an incorrect note for that string. Usually, guitar strings are tuned to "standard" open-fret notes. The "standard" open-fret notes for guitar strings are E, A, D, G, B, and E. The "standard" open-fret notes for bass guitar strings are E, A, D, and G. All other notes, including sharps and flats, can be called "non-standard" notes.

Since tuning guitar strings to non-standard notes may be desired at times, the above display desirably provides information allowing a musician to tune a string to any note of the musical scale (including standard and non-standard notes). Displaying the tuning of a non-standard note may be desired, for example, if the musician is purposefully tuning the open-fretted guitar strings to a non-standard tuning to play the guitar in a special key. Displaying the tuning of a non-standard note may also be desired if the musician is tuning a fretted string, rather than an open-fretted string. However, the ability to display the tuning of a non-standard note may also lead to the inadvertent tuning to an unintentionally non-standard note.

A musical may inadvertently tune a string to a non-standard note when standing distant from the display or in a darkened location. In making such an error, the musician might not be able to read the display clearly. For example, a musician might erroneously tune a guitar string to the note F rather than to the desired note E because the light devices for these two notes are located near each other on the display and are similar in appearance. Also, musicians often tune electric guitars while amplifiers connected to the guitars are turned off, making the visual indications of the played pitch given to the musician critical. Errors in tuning may thus occur using the above device since it does not indicate to the musician that the played note is a non-standard note.

Accordingly, it is an object of the present invention to provide an illuminated display for a chromatic tuner which is visually easy to interpret, and is compact.

It is a further object of the present invention to provide a chromatic tuner display which can show a large number of increments of pitch variation with a relatively small number of light devices.

It is an additional object of the invention to provide a chromatic tuner display which is color coded for rapid visual recognition, and which includes illuminated letters corresponding to the musical notes of a chromatic scale for easier use.

Still another object of the invention is to provide a chromatic tuner display which provides information allowing fine tuning of a string, which is simple for a musician to read, and Yet another object of the invention is to provide a chromatic tuner display which provides a musician with an indication of whether a string is tuned to a pitch corresponding to a standard guitar note or a non-standard guitar note, which is simple for the musician to read, and which does not have a cluttered face.

Additional objects and advantages of the invention will be apparent from the description which follows, or may be learned by practice of the invention.

SUMMARY OF THE INVENTION

To achieve the foregoing objects and advantages, and in accordance with the purposes of the invention as embodied and broadly described herein, the chromatic tuner display of the present invention is provided for indicating a relative difference between a pitch of a sound and a pitch of a desired note of a musical scale. The display comprises a base member, a predetermined point on the base member corresponding to the pitch of the desired note, and colored light means for visually representing the pitch of the sound. The colored light means is mounted on the base member and includes a plurality of illuminative letters corresponding to notes of the musical scale, and a plurality of additional illuminative characters positioned on the base member between adjacent letters corresponding to sharp and flat variations of the notes represented by the letters. An illuminated letter or an illuminated letter and character combination represents the desired note. The colored light means also includes a plurality of opposing pairs of colored light devices for visually indicating whether the sound is above or below the pitch of the desired note, each light device within a given opposing pair being disposed on an opposite side of the predetermined point from the other light device within the given opposing pair. Each opposing pair has a specified color for visually indicating the relative difference in the pitch of the sound from the desired note.

The colored light means may also indicate whether the desired note is a standard guitar note or a non-standard guitar note. Additionally, the colored light means may indicate whether the pitch of the sound is within a first predetermined range from the pitch of the desired note which is smaller than a second predetermined range of about ±2 to 3.5 cents from the pitch of the desired note. The colored light means may also indicate whether the pitch of the sound is outside of the first predetermined range but within the second predetermined range.

As an option, the opposing pairs of ascending and descending light devices may have alternating shapes. It is preferred that the opposing pairs include at least red, yellow and green light devices. The colored light means may include at least one multiple opposing pair of light devices of the same color.

It is preferred that the colored light means also includes a central light device positioned at the predetermined point for illuminating when a musical sound is within the first predetermined range from a desired note represented by an illuminated letter or letter and character combination. At least one of the opposing light devices may flash intermittently when the sound has a pitch falling within the second predetermined range but outside the first predetermined range, and may illuminate when the sound has a pitch falling outside of the second predetermined range.

The colored light means may include three opposing pairs of red light devices, two opposing pairs of yellow light devices and one opposing pair of green light devices, the green light devices being arranged adjacent to the central light device and the yellow and red light devices being successively further from the central light device. A numerical scale may also be provided on the base member, each number of the scale corresponding to one of the light devices for indicating the relative difference in pitch of a the sound from the desired note.

The illuminative letters and characters may be white, and the colored light devices may be adapted to be energized in successive sequences as the pitch of the sound becomes closer or farther from the desired note. Each sequence may include a single one of the colored light devices, followed by a pair of adjacent colored light devices and the other colored light device of the adjacent pair. This increases the number of increments of pitch variation which may be visually displayed, without the need for an excessive number of light devices.

BRIEF DESCRIPTION OF THE DRAWINGS

The accompanying drawings which are incorporated in and constitute a part of the specification, illustrate the presently preferred embodiments of the invention and, together with the description, serve to explain the principles of the invention.

DESCRIPTION OF THE PREFERRED EMBODIMENTS

Reference will now be made in detail to the present preferred embodiments of the invention, as illustrated in the accompanying drawings.

The present invention is a chromatic tuner display for use with an electronic tuning aid apparatus. In accordance with the invention, the chromatic tuner display of the present invention is provided for indicating a relative difference between a pitch of a sound and a pitch of a desired note of a musical scale. The display comprises a base member, a predetermined point on the base member corresponding to the pitch of the desired note, and colored light means for visually representing the pitch of the sound. The colored light means is mounted on the base member and includes a plurality of illuminative letters corresponding to notes of the musical scale, and a plurality of additional illuminative characters positioned on the base member between adjacent letters corresponding to sharp and flat variations of the notes represented by the letters. An illuminated letter or an illuminated letter and character combination represents the desired note. The colored light means also includes a plurality of opposing pairs of colored light devices for visually indicating whether the sound is above or below the pitch of the desired note, each light device within a given opposing pair being disposed on an opposite side of the predetermined point from the other light device within the given opposing pair. Each opposing pair has a specified color for visually indicating the relative difference in the pitch of the sound from the desired note.

Figure 1:
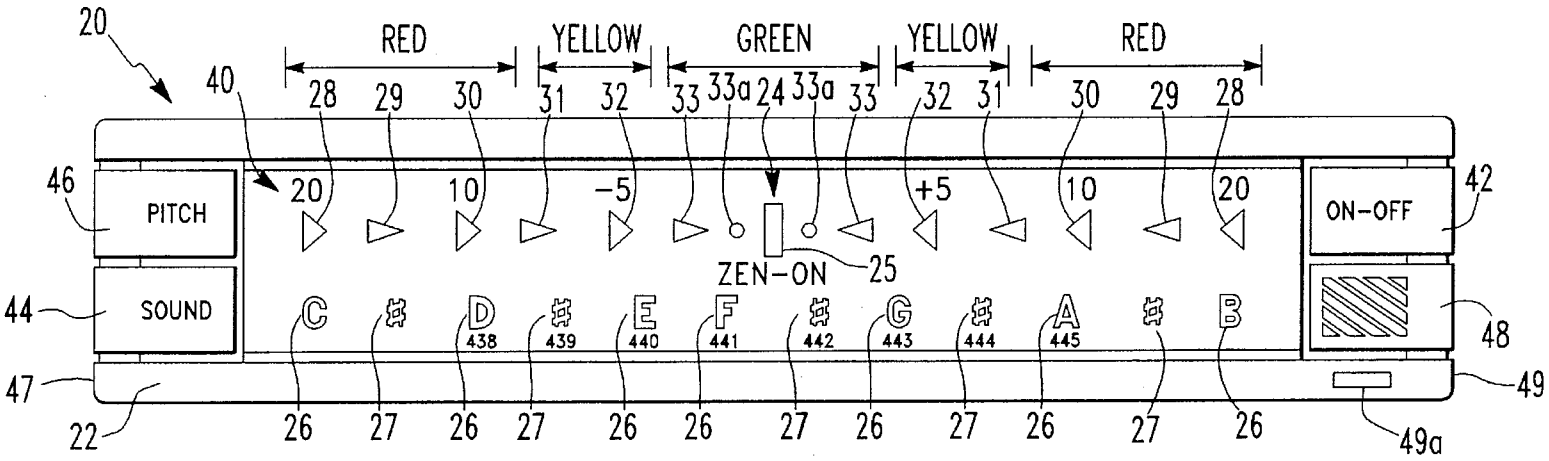
FIG. 1 is a front view of a chromatic tuner display of the present invention.

As shown in FIG. 1, the tuner display, generally designated by the numeral 20, includes a base member 22 for supporting the other components of the display. A predetermined point 24 on the base member corresponds to the precise pitch of a desired musical note. In the illustrated embodiment, the colored light means includes a plurality of illuminative letters 26 ordered for corresponding to the notes of the musical scale. A plurality of additional illuminative characters 27 are positioned on the base member 22 between adjacent letters 26 for corresponding to sharp and flat variations of the lettered musical notes. As shown in FIG. 1, a plurality of colored light devices 28, 29, 30, 32, 33 are arranged in opposing pairs of ascending and descending light device on opposite sides of the predetermined point 24. Each opposing pair 28, 29, 30, 31, 32, 33 may have a specified color for visually indicating the relative difference in pitch above or below the pitch of the musical note represented by one of the illuminated letters 26 or a combination of letters 26 and characters 27. The particular arrangement of the colored light devices visually indicates the relative difference in pitch of the musical sound from the pitch of the desired musical note. As shown in FIG. 1, the opposing pairs of ascending and descending light devices 28–33 may have alternating shapes for easier recognition. In addition, the opposing pairs may include at least red, yellow and green light devices, as shown by the labels in FIG. 1.

In the embodiment illustrated in FIG. 1, a central light device 25 is positioned at the predetermined point 24 for illuminating when a musical sound corresponds closely to the precise pitch of the desired musical note represented by an illuminated letter or letter and character combination.

As illustrated in FIG. 1, the display 20 may include three opposing pairs of red light devices, two opposing pairs of yellow light devices and one opposing pair of green light devices. The green devices 33 may be arranged adjacent to the central light device 25, and the yellow (31, 32) and red (28, 29, 30) devices may be successively further from the central light device 25. In addition, a numerical scale 40 may be arranged on the base member. Each number of the scale 40 corresponds to one of the light devices for indicating the relative difference in pitch of a musical sound from the pitch of the desired musical note.

As explained above, typically, chromatic tuning devices indicate the variance from an exact pitch of a note in units of 100 "cents," with 0 indicating exact pitch, and a maximum error of ±50 cents. The numerical scale 40 provides a visual indication of the pitch variation by calibrating the tuner to correspond with the scale being used. Thus, information about the amount of pitch error in cents is accurately shown and may be easily recognized.

The base member may also act as a support for other control buttons of the chromatic tuner, such as an on-off button 42, a sound activation button 44, and a pitch activation button 46. In addition, an optional illuminated display 48 may be included to visually indicate when the tuner is turned on.

In operation, the chromatic tuner is turned on and automatically calibrated to 440 Hz. When a musical sound is received by the tuner, a note 26, corresponding to the sound detected, of the chromatic scale is illuminated either alone or with an adjacent character 27. The opposing pairs of light devices also illuminate to indicate the pitch variation of the sound from the precise pitch of the illuminated note 26. For example, a rapid flashing of the outermost red light device 28 may indicate that the pitch is ±35 to 50 cents from true pitch. A slower rate of flashing of the same light device could signify a ±25 to 35 cents. A constant light on the red light device 28 may signify ±20 to 25 cents pitch variation. A constant light on both of the light devices 28 and 29 may signify ±16 to 20 cents variation. The following table illustrates one possible arrangement of illumination which may be used to indicate pitch variation.

TABLE 1

| | |
|---|---|
| Green 25 | ±2 cents |
| Green 25 and Green 33 | ±2–3.5 |
| Green 33 and Yellow 32 | ±3.5–5 |
| Yellow 32 | ±5–6.5 |
| Yellow 32 and Yellow 31 | ±6.5–8 |
| Yellow 31 and Red 30 | ±8–10 |
| Red 30 | ±10–13 |
| Red 30 and Red 29 | ±13–16 |
| Red 29 and Red 28 | ±16–20 |
| Red 28 | ±20–25 |
| Red 28 (flashing slowly) | ±25–35 |
| Red 28 (flashing rapidly) | ±35–50 |

Chromatic tuners of the type described herein are generally in use, and the electronic and circuit elements of such devices are well known to those skilled in the art. Accordingly, a detailed discussion of the internal circuitry and electronic components of these types of devices is not set forth in this application. An example of a tuner of this general type having a display with both light devices and a meter device is one marketed under the trademark CHROMATINA 331 by Zen-on Music Co., Ltd. of Tokyo, Japan. Another such chromatic tuner having an LED meter device is marketed under the name DIGITAL TUNER DT-2 by Korg, Inc. of Tokyo, Japan. Circuitry such as that used in these commercially available tuners and others described above in the background section of this application would be suitable for operating the tuner display of the present invention, and is known to those skilled in the art. The construction of a tuner having the display of the present invention is believed to be well within the capability of those skilled in the art.

Based on the pitch variation shown by the illuminated light devices, the musician may adjust the tension of the particular string of the instrument. During this adjustment, the string may be replayed repeatedly so that the variation of pitch toward or away from the true pitch may be observed on the tuner display 20. The green center light 25 may remain flashing at a medium speed to serve as a reference point throughout the tuning process. In addition, the note B or another selected illuminative note or character may be designated to flash intermittently for indicating when the battery power is weak.

Tuning a string to within 2 or 3 cents, as is possible using the arrangement of Table 1, is generally adequate for most situations because most people cannot discern changes in pitch smaller than 2 or 3 cents. However, in some situations, such as during recording sessions, tuning to within about 1 cent is desired. The tuner display 20 may therefore provide a display allowing a musician to fine tune a string to within a range of about 1 cent, or any other range smaller than about 2 cents. While the micro-tuning function is intended to be operational at all times, an optional button 47 may be provided on the face of the tuner display 20 to turn off the fine tuning function.

In order to allow such fine tuning, the colored light means may indicate whether the pitch of the played sound is within a first predetermined range from the pitch of the desired note which is smaller than a second predetermined range of about ±2 to 3.5 cents from the pitch of the desired note. As broadly embodied herein, the first predetermined range may be about ±1 cent from the desired pitch.

Preferably, the colored light means indicates that the pitch of the sound is within the first predetermined range, and also indicates that the pitch of the sound is within the second predetermined range but outside of the first predetermined range. To indicate that the sound is within the first predetermined range (for example, ±1 cent), the central light device 25 may be illuminated continuously and alone. To indicate that the sound is inside the second predetermined range, but outside of the first predetermined range (for example, ±1 to 2 cents), the light device 33 adjacent the central light device 25 illuminates repeatedly and at intervals, and the central light device 25 illuminates continuously. Preferably, the light device 33 illuminates for about 0.1 seconds or less at intervals of about 1.0 seconds. More preferably, the light device 33 illuminates for about 0.025 seconds. This brief illumination at relatively longer intervals differentiates the mode of illumination of the light device 33 when the pitch of the sound is within ±2 to 3.5 cents (continuously illuminated) from the mode of illumination when the sound is within the second, but not the first, predetermined range (flashing).

The display of a quick flash at relatively long intervals serves to intuitively indicate to the musician the extra precision of the fine tuning mode. That is, the musician will be aware that, when the pitch of the sound is within 2 to 3.5 cents and the central light device 25 and the light device 33 are continuously illuminated, a string is effectively in tune. When the light device 33 is flashing, the string is more closely in tune. When only the central light device 25 is illuminated, the string is even more closely in tune. However, the intermittent flashing intuitively informs the musician that tuning the string to within the first predetermined range is generally not required for most occasions.

Thus, in the fine tuning mode, if the pitch of the note played is within the first predetermined range of the pitch of the desired note, the central light device 25 is continuously illuminated. If the pitch of the note played is within 1 and 2 cents of the pitch of the desired note, the central light 25 is continuously illuminated, and the light device 33 is intermittently illuminated. If the pitch played is within 2 to 3.5 cents of the pitch of the desired note, both the central light device 25 and the corresponding light device 33 are continuously illuminated.

The use of a flashing light device 33 during fine tuning makes unnecessary the provision of an additional set of lighted arrows between light devices 33 and 25. However, two small light devices **33*a*, located one each between the central light device 25 and the light devices 33, may be used to indicate fine tuning. A corresponding one of the small light devices 33*a* may be continuously or intermittently illuminated when the pitch played is within the second, but not the first, predetermined range of the pitch of the desired note, instead of causing light device 33 to flash. To avoid cluttering the face of the tuner display 20, and since the fine tuning mode would not generally be needed or used by musicians, the light devices 33*a* are preferably smaller than the other light devices 28–33**.

The tuner display 20 may, if desired, also operate in a special guitar tuning mode. In this mode, the information provided by the display 20 to the musician differs depending on whether the pitch played corresponds to a "standard" or "non-standard" guitar tuning note. The colored light means may thus indicate whether the desired note is a standard guitar note or a non-standard guitar note.

As explained above, the standard open-fret notes for guitar strings are E, A, D, G, and B, and the remaining non-standard guitar notes are C, F, C sharp (D flat), D sharp (E flat), F sharp (G flat), G sharp (A flat), and A sharp (S flat). The standard open-fret notes for bass guitar strings are E, A, D, and G. Therefore, non-standard bass guitar notes include the non-standard guitar notes plus B.

The guitar mode may be activated by pressing a button 49 on the face of the tuner display 20. If desired, a bass guitar mode may be provided in addition to or instead of the guitar mode, activated by the button 49 or another button. Since the difference between standard guitar notes and standard bass guitar notes is only the note B, a bass guitar may be tuned with the tuner display operating in the guitar mode while deriving the benefits of the invention.

In the guitar mode, when the pitch played corresponds to one of the above standard guitar notes, the tuner display 20 operates as described above. That is, the corresponding note 26 on the tuner display 20 is illuminated continuously, and the light devices 25 and 28–33 are illuminated during tuning. When, for any reason, a musician plays a pitch corresponding to a non-standard note (that is, a pitch within 50 cents of a non-standard note), the corresponding illuminative letter 26 or letter 26 and character 27 combination flash rapidly. Preferably, the illuminative letters 26 and characters 27 flash more rapidly than the optional flashing of the green center light 25 denoting the pitch reference point, and more rapidly than the optional flashing of the illuminative letter B denoting a low battery, so that the different flashing speeds are easily discernible by the musician. Thus, the musician can readily discern that the note played is not a standard note.

Alternately, instead of causing the illuminative letters 26 and characters 27 to flash rapidly to designate non-standard notes, a separate light device 49a may be provided on the tuner display 20 which illuminates continuously or flashes when a non-standard note is played.

Figure 2:
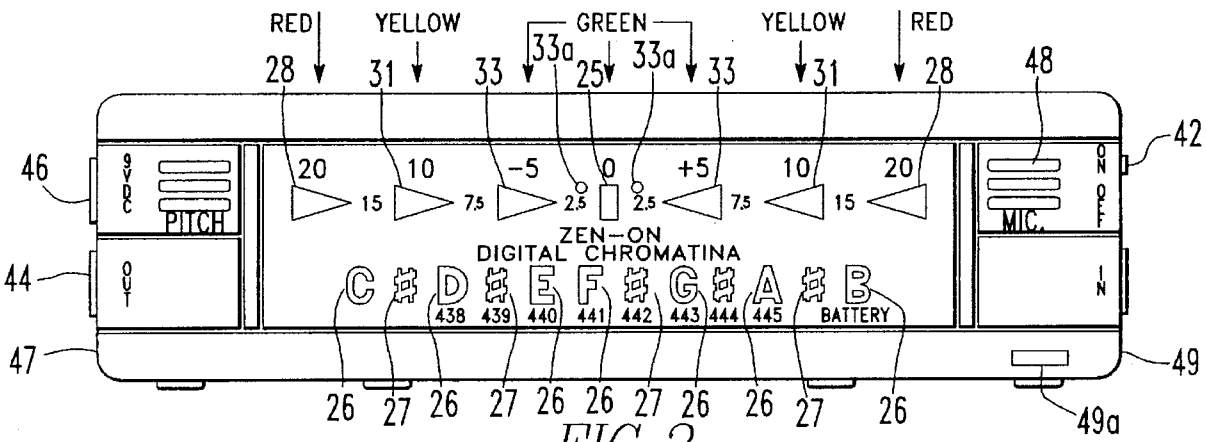
FIG. 2 is a front view of an alternative embodiment of the chromatic tuner display of the invention.

FIG. 2 illustrates another embodiment of the invention which is similar to the embodiment of FIG. 1. Like reference numerals have been used in FIG. 2 for similar elements to those in FIG. 1. The embodiment of FIG. 2 is more compact than that of FIG. 1 in that fewer light devices are utilized. In FIG. 2, the illuminative letters and characters are the same as in FIG. 1. However, only three opposing pairs of light devices are provided for indicating the pitch variation. As shown in FIG. 2, opposing pairs of red, yellow and green light devices 28, 31 and 33 are provided. In addition, there is a central light device 25 as in the embodiment of FIG. 1. An example of an illumination pattern which may be used with the embodiment of FIG. 2 is set forth in the following table.

TABLE 2

| | |
|---|---|
| Green 25 and Two Green 33 | ±2 cents |
| Green 25 and One Green 33 | ±2–4 |
| One Green 33 | ±4–6 |
| Green 33 and Yellow 31 | ±6–9 |
| Yellow 31 | ±9–14 |
| Yellow 31 and Red 28 | ±14–19 |
| Red 28 | ±19–25 |
| Red 28 (slow flashing) | ±25–35 |
| Red 28 (rapid flashing) | ±35–50 |

The illumination of the letters and adjacent characters is the same as in the embodiment of FIG. 1.

The device of FIG. 2 may also operate in a fine tuning mode or a guitar tuning mode. In the fine tuning mode, a light device 33 may flash intermittently, as described above, when the pitch of the sound is in a second, but not a first, predetermined range, or additional light devices 33*a* may be provided.

Figure 3:
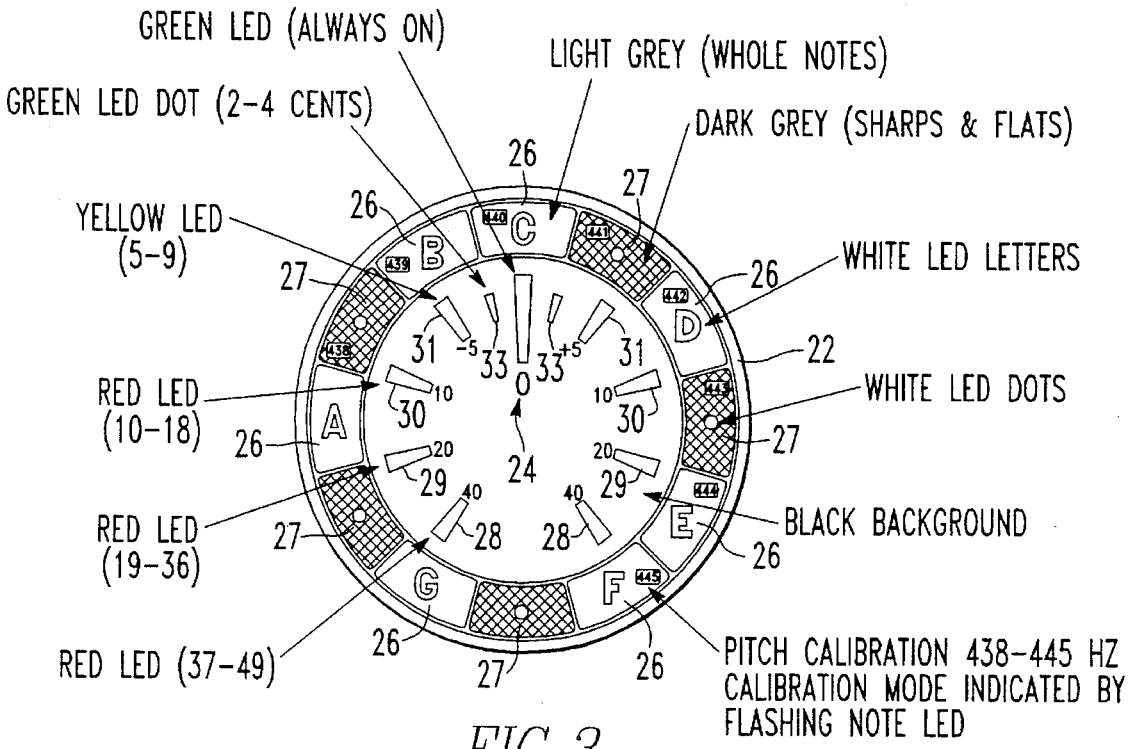
FIG. 3 is a front view of an alternative embodiment wherein the chromatic tuner display is circular in shape.

FIG. 3 shows an alternative embodiment in which the tuner display has a circular configuration. Like reference numerals are used in FIG. 3 for similar elements as in FIG. 1. The illuminative letters and characters are arranged in a circle on the perimeter of the base member 22. The light devices 28, 29, 30, 31 and 33 are also arranged in a circle concentric with and within the circle formed by the illuminative letters 26 and characters 27. The circular arrangement of pitch information concentrically within the chromatic note selection provides a very compact arrangement which accurately and quickly conveys pitch variation information to the user.

Figure 4:
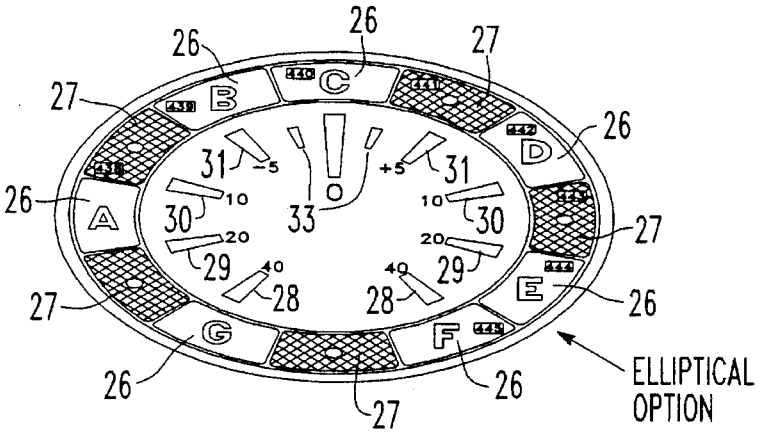
FIG. 4 shows another embodiment wherein the chromatic tuner display is elliptical in shape.

The embodiment shown in FIG. 4 is similar to that of FIG. 3 except that the base member is elliptical in shape. The illuminative letters and the light devices are concentrically arranged as in the embodiment of FIG. 3.

Figure 5:
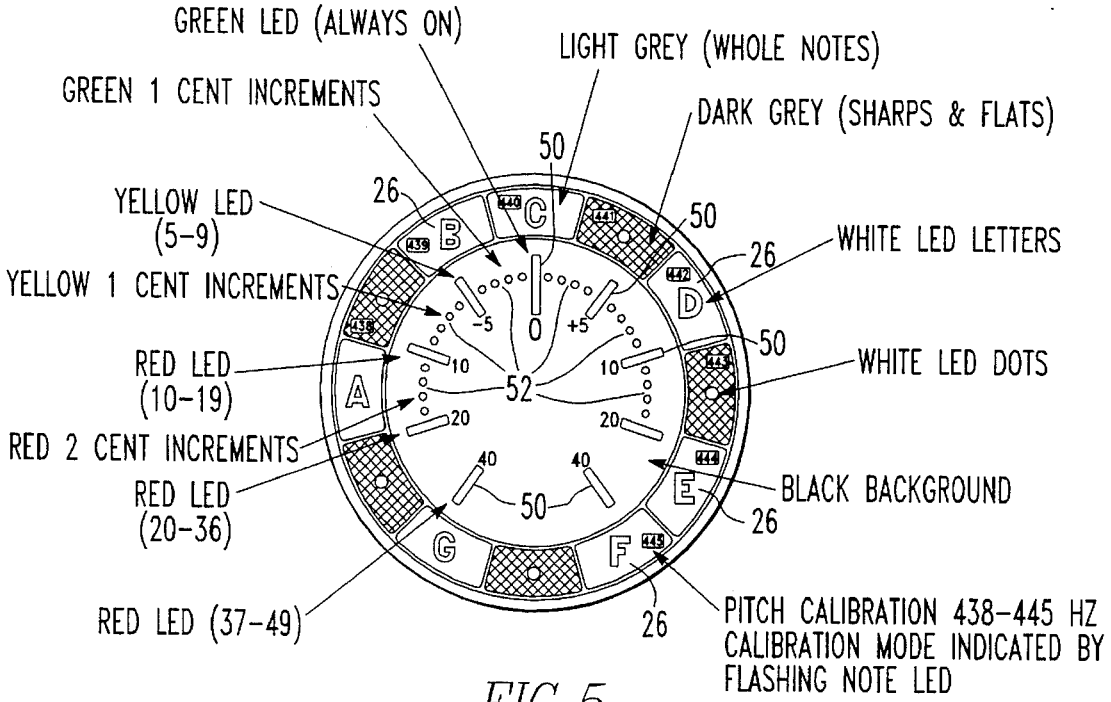
FIG. 5 is another embodiment of the chromatic tuner display which is circular in shape.
Figure 6:
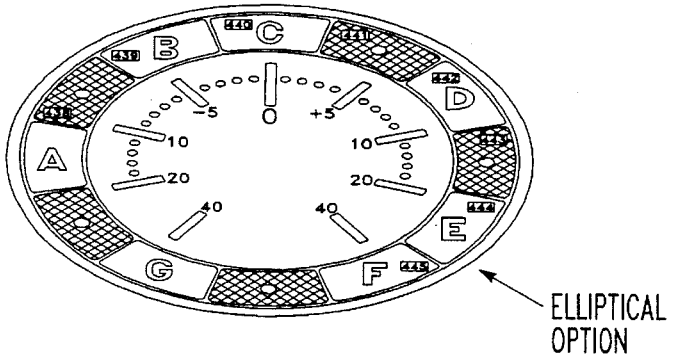
FIG. 6 is an alternative embodiment of the elliptical chromatic tuner display.

FIGS. 5 and 6 illustrate further embodiments which are very similar to those of FIGS. 3 and 4. In FIG. 5, the tuner display is circular, as in FIG. 3. However, the light devices are in the form of lines 50 and intervening dots 52. The larger number of dots provides a higher degree of accuracy in representing the pitch variation. FIG. 6 is similar to FIG. 5 in that the light devices are in the form of lines and dots.

Figure 7:
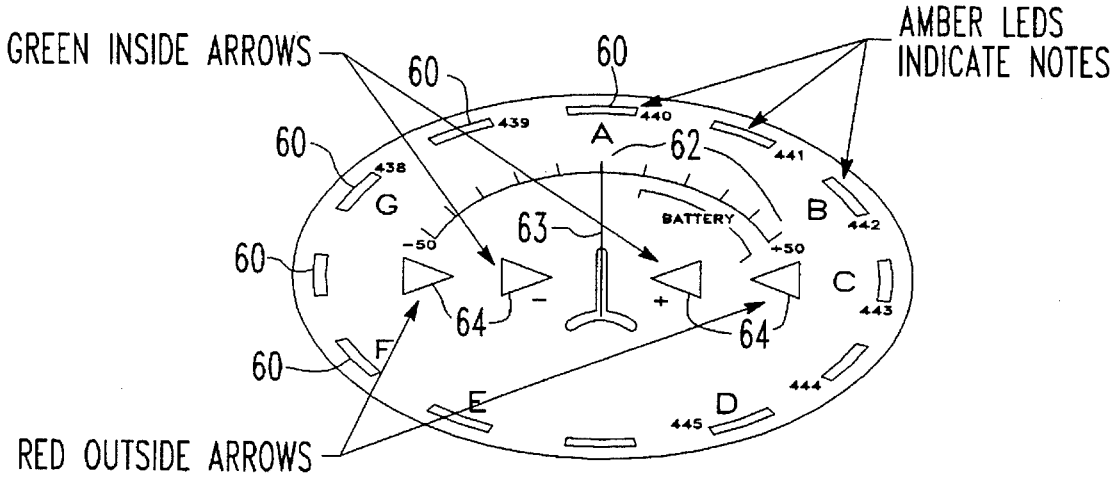
FIG. 7 is a further embodiment of a chromatic tuner display which may be used with an analog-type meter.

FIG. 7 represents a display which could be used with an analog type tuner. A series of lights 60 is arranged around the perimeter of the display for representing the musical notes and sharp and flat variations thereof. The precise measurement of pitch variation is made using a meter type scale 62 with a moveable dial 63. However, two opposing pairs of light devices 64 are also included for representing visually the magnitude of the pitch variation. This display is particularly useful in connection with an analog tuning mechanism.

The structure of the present invention, which is compact and easy to operate, allows for rapid recognition of pitch variations and easier tuning of stringed instruments. The associative meaning of the colors provides a very quick reference for the user. By displaying graphically and illuminatively the interval relationships between the notes, the display of the present invention provides a marked improvement over the prior art.

Additional advantages and modifications will readily occur to those skilled in the art. The invention in its broader aspects is therefore not limited to the specific details, representative apparatus and illustrative examples shown and described. Accordingly, departures may be made from such details without departing from the spirit or scope of the general inventive concept defined by the appended claims and their equivalence.

What is claimed is:

1. A chromatic tuner display for comparing a pitch of a sound to notes of a musical scale, the display comprising:

a base member;

a plurality of translucent elements mounted on the base member corresponding to the notes of the musical scale;

first means for selectively illuminating the translucent elements to indicate which note of the scale is closest in pitch to the sound; and second means for selectively illuminating the translucent elements to indicate whether the note closest in pitch to the sound is a standard guitar note or a non-standard guitar note.

2. The tuner display of claim 1, wherein the translucent elements include letters corresponding to notes of the musical scale and characters corresponding to sharp and flat variations of the notes represented by the letters, the first selective illuminating means illuminating at least one of the translucent elements to represent the note closest in pitch to the sound.

3. The tuner display of claim 2, wherein the second selective illuminating means illuminates the at least one translucent element continuously if the note closest in pitch to the sound is a standard guitar note, and the second selective illuminating means illuminates the at least one translucent element intermittently if the note closest in pitch to the sound is a non-standard guitar note.

4. The tuner display of claim 2, wherein the translucent elements further include a non-standard note indicator, the second selective illuminating means illuminating the non-standard note indicator if the note closest in pitch to the sound is a non-standard guitar note.

5. The tuner display of claim 1, wherein the standard guitar notes include E, A, D, G, and B, and the non-standard guitar notes include C, F, A sharp, B flat, C sharp, D flat, D sharp, E flat, F sharp, G flat, G sharp, and A flat.

6. A chromatic tuner display for comparing a pitch of a sound to notes of a musical scale, the display comprising:

a base member;

a plurality of translucent elements mounted on the base member corresponding to the notes of the musical scale;

first means for selectively illuminating the translucent elements to indicate which note of the scale is closest in pitch to the sound; and second means for selectively illuminating the translucent elements to indicate whether the note closest in pitch to the sound is a standard bass guitar note or a non-standard bass guitar note.

7. The tuner display of claim 6, wherein the translucent elements include letters corresponding to notes of the musical scale and characters corresponding to sharp and flat variations of the notes represented by the letters, the first selective illuminating means illuminating at least one of the translucent elements to represent the note closest in pitch to the sound.

8. The tuner display of claim 7, wherein the second selective illuminating means illuminates the at least one translucent element continuously if the note closest in pitch to the sound is a standard bass guitar note, and the second selective illuminating means illuminates the at least one translucent element intermittently if the note closest in pitch to the sound is a non-standard bass guitar note.

9. The tuner display of claim 7, wherein the translucent elements further include a non-standard note indicator, the second selective illuminating means illuminating the non-standard note indicator if the note closest in pitch to the sound is a non-standard bass guitar note.

10. The tuner display of claim 6, wherein the standard bass guitar notes include E, A, D, and G, and the non-standard bass guitar notes include B, C, F, A sharp, B flat, C sharp, D flat, D sharp, E flat, F sharp, G flat, G sharp, and A flat.

11. A chromatic tuner display for indicating a relative difference between a pitch of a sound and a pitch of a desired note of a musical scale, the display comprising:

a base member;

a plurality of translucent elements mounted on the base member including a plurality of letters corresponding to notes of the musical scale, a plurality of characters corresponding to sharp and flat variations of the notes represented by the letters, a central light device corresponding to the pitch of the desired note, and a plurality of indicators, each of the indicators corresponding to a different predetermined difference in pitch between the sound and the desired note;

means for selectively illuminating the translucent elements to visually represent the pitch of the sound and the desired note, the illuminating means illuminating one of the letters or a combination of one of the letters and one of the characters to represent the desired note, the illuminating means also illuminating at least one of the indicators to indicate the relative difference in the pitch of the sound from the pitch of the desired note; and means for indicating whether the pitch of the sound is within a first predetermined range, a second predetermined range, or in between the first and second predetermined ranges from the pitch of the desired note, the second predetermined range being about ±2 to 3.5 cents from the pitch of the desired note, and the first predetermined range being smaller than the second predetermined range, the indicating means continuously illuminating the central light device when the pitch of the sound is within the first predetermined range, the indicating means illuminating the central light device continuously and one of the indicators adjacent the central light device briefly and at intervals when the sound has a pitch in between the first and second predetermined ranges, the indicating means illuminating the indicator continuously when the sound has a pitch within the second predetermined range.

12. The display of claim 11, wherein the first predetermined range is about ±1 cent from the pitch of the desired note.

13. The display of claim 11, wherein the indicator illuminates for about 0.1 seconds or less at intervals of about 1.0 second or more when the sound has a pitch falling between the first and second predetermined ranges.

* * * * *

UNITED STATES PATENT AND TRADEMARK OFFICE

CERTIFICATE OF CORRECTION

PATENT NO. : 5,549,028

DATED : August 27, 1996

INVENTOR(S) : Ned Steinberger

It is certified that error appears in the above-identified patent and that said Letters Patent is hereby corrected as shown below:

Item [57]

Delete the "Abstract" in its entirety and substitute the following:

A chromatic tuner display compares a pitch of a sound to notes of a musical scale. The display includes a base member and a plurality of translucent elements mounted on the base member corresponding to the notes of the musical scale. The translucent elements are selectively illuminated to indicate which note of the scale is closest in pitch to the sound, and to indicate whether the note closest in pitch to the sound is a standard guitar or bass guitar note or a non-standard guitar or bass guitar note. The tuner display may also indicate whether the pitch of the sound is within a first predetermined range, a second predetermined range, or in between the first and second predetermined ranges from the pitch of the desired note.

Signed and Sealed this

Twelfth Day of November, 1996

*Attest:*

Bruce Lehman

BRUCE LEHMAN

*Attesting Officer*

*Commissioner of Patents and Trademarks*